US007864117B2

(12) United States Patent
Aurinsalo et al.

(10) Patent No.: US 7,864,117 B2
(45) Date of Patent: Jan. 4, 2011

(54) WIDEBAND OR MULTIBAND VARIOUS POLARIZED ANTENNA

(75) Inventors: Jouko Aurinsalo, Espoo (FI); Jussi Säily, Espoo (FI)

(73) Assignee: Nokia Siemens Networks Oy, Espoo (FI)

( * ) Notice: Subject to any disclaimer, the term of this patent is extended or adjusted under 35 U.S.C. 154(b) by 412 days.

(21) Appl. No.: 12/151,723

(22) Filed: May 7, 2008

(65) Prior Publication Data

US 2009/0278746 A1 Nov. 12, 2009

(51) Int. Cl.
*H01Q 1/38* (2006.01)

(52) U.S. Cl. ..... 343/700 MS; 343/702; 343/846

(58) Field of Classification Search ..... 343/700 MS, 343/702, 824, 833, 834, 846
See application file for complete search history.

(56) References Cited

U.S. PATENT DOCUMENTS

| | | | | |
|---|---|---|---|---|
| 5,420,596 | A * | 5/1995 | Burrell et al. | 343/700 MS |
| 5,923,296 | A | 7/1999 | Sanzgiri et al. | 343/700 |
| 5,955,994 | A * | 9/1999 | Staker et al. | 343/700 MS |
| 6,069,586 | A * | 5/2000 | Karlsson et al. | 343/700 MS |
| 6,317,100 | B1 | 11/2001 | Elson et al. | 343/853 |
| 6,320,544 | B1 * | 11/2001 | Korisch et al. | 343/700 MS |
| 6,819,300 | B2 | 11/2004 | Gottl | 343/799 |
| 7,202,818 | B2 | 4/2007 | Anguera Pros et al. | 343/700 |
| 7,773,035 | B2 * | 8/2010 | Murata et al. | 343/700 MS |
| 2007/0126641 | A1 | 6/2007 | Saily | 343/700 |

OTHER PUBLICATIONS

Dual-Polarized Board-Band Microstrip Antennas Fed by Proximity Coupling, Steve (Shichang) Gao and Alistair Sambell, IEEE Transactions on Antennas and Propagation. vol. 53, No. 1, Jan. 2005.

"On the Available Diversity Gain from Different Dual-Polarized Antennas", Bjorn Lindmark and Martin Nilsson, IEEE Journal on Selected Areas in Communications, vol. 19, No. 2 Feb. 2001.

"The Performance of Polarization Diversity Schemes at a Base Station in Small/Micro Cells at 1800 MHz" Jukka J. A. Lempiainen and Jaana K. Laiho-Steffens, IEEE Transactions on Vehicular Technology, vol. 47, No. 3, Aug. 1998.

"Antenna Beamwidth Control Using Parasitic Subarrays", I.A. Korisch, B. Rulf, Lucent Technologies, Inc., 2000 IEEE-APS Conference.

"Microstrip Antennas Integrated With Electromagnetic Band-Gap (EBG) Structures: A Low Mutual Coupling Design for Array Applications", Fan Yang and Yahya Rahmat-Samii, IEEE Transactions on Antennas and Propagation, vol. 51, No. 10, Oct. 2003.

(Continued)

*Primary Examiner*—Hoang V Nguyen
(74) *Attorney, Agent, or Firm*—Ware, Fressola, Van Der Sluys & Adolphson, LLP; Bradford Green

(57) ABSTRACT

A microstrip patch antenna wherein the half-power beamwidths of two orthogonal polarizations can be widened or narrowed in desired frequency bands around its center frequency. The result is a wideband or multiband antenna with desired beamwidth characteristics. In particular, the antenna can be arranged to be singly-polarized, dual-polarized or circularly-polarized. Using at least two parasitic patches on each of the two opposing sides of a primary radiating patch, both E-plane (electric field) and H-plane (magnetic field) parasitic couplings can be simultaneously achieved. By introducing uneven current distribution along the patch principal axis, some sub-bands of the antenna pattern can be beam steered.

23 Claims, 11 Drawing Sheets

OTHER PUBLICATIONS

"Proximity-coupled and Dual-polarized Microstrip Patch Antenna for WCDMA Base Station Arrays", Jussi Saily, VTT Technical Research Centre of Finland, Proceedings of Asia-Pacific Microwave Conference 2006.

* cited by examiner (H-Plane Coupling)

(E-Plane Coupling)

WIDEBAND OR MULTIBAND VARIOUS POLARIZED ANTENNA

FIELD OF THE INVENTION

The present invention relates generally to WLAN access point, WiMAX and other cellular communication base station antennas and, more particularly, to proximity-coupled microstrip patch antennas.

BACKGROUND OF THE INVENTION

A metropolitan area, for example, generally requires wireless local area network (WLAN) access points for short range communication needs. WLAN deployment is typically based on wireless backhaul connections between adjacent access points. The backhaul connections operate on a higher frequency range than the mobile access (4.9-5.825 GHz vs. 2.4-2.485 GHz). In order to reduce the multipath fading of received signals, polarization diversity is generally used. A dual-polarized (vertical and horizontal) microstrip antenna can be used for the above-described purposes.

Currently at least two variants of the antenna for a 120 degree horizontal sector are required. The main difference between these variants is in the operating band of the horizontal polarization (HP) backhaul diversity beam. For European Union (EU) markets, a single band of 5.47-5.725 GHz needs to be covered by the diversity beam. For the United States (US) markets, the diversity beam should cover both 5.25-5.35 GHz and 5.75-5.825 GHz bands.

SUMMARY OF THE INVENTION

The present invention provides a method and antenna wherein the half-power beamwidths of two orthogonal polarizations can be widened or narrowed in desired frequency bands around its center frequency. The result is a wideband or multiband antenna with desired beamwidth characteristics. In particular, the antenna is a microstrip patch antenna which can be arranged to be singly-polarized, dual-polarized or circularly-polarized. Using at least two parasitic patches on each of the two opposing sides of a primary radiating patch, both E-plane (electric field) and H-plane (magnetic field) parasitic couplings can be simultaneously achieved.

Thus, the first aspect of the present invention is a method, comprising:

providing a radiative plane in an antenna, wherein the radiative plane comprises a primary radiative element and a plurality of separate parasitic radiative elements spaced from the primary radiative element, the primary radiative element having a first side and an opposing second side, the first and second sides parallel to a first axis, and wherein at least two of the parasitic radiative elements are arranged on the first side and at least another two of parasitic radiative elements are arranged on the second side, wherein said at least two of the parasitic radiative elements arranged on the first side comprise a first parasitic radiative element having a longitudinal axis substantially parallel to the first axis and a second parasitic radiative element having a longitudinal axis substantially perpendicular to the first axis, and wherein said at least another two of the parasitic radiative elements arranged on the second side comprise a third parasitic radiative element having a longitudinal axis substantially parallel to the first axis and a fourth parasitic element having a longitudinal axis substantially perpendicular to the first axis;

arranging a ground plane spaced from the radiative plane, wherein the ground plane comprises a plurality of separate slots, each slot having a middle section connected to two opposite end sections, and said plurality of slots comprise a first slot and a second slot, wherein the middle section of the first slot has a longitudinal axis substantially parallel to the first axis and the middle section of the second slot has a longitudinal axis substantially parallel to the first axis; and arranging a plurality of feed lines adjacent to but electrically isolated from the ground plane, wherein said plurality of feed lines comprise a first feed line and a second feed line, and wherein the first feed line comprises a longitudinal section substantially perpendicular to the first axis, one end of the longitudinal section adjacent to the middle section of the first slot, and the second feed line comprises a longitudinal section substantially parallel to the first axis, one end of the longitudinal section adjacent to the middle section of the second slot.

The second aspect of the present invention is an antenna, comprising:

a radiative plane;

a ground plane spaced from the radiative plane; and a plurality of feed lines adjacent to but electrically isolated from the ground plane, wherein the radiative plane comprises a primary radiative element and a plurality of separate parasitic radiative elements spaced from the primary radiative element, the primary radiative element having a first side and an opposing second side, the first and second sides parallel to a first axis, and wherein at least two of the parasitic radiative elements are arranged on the first side and at least another two of parasitic radiative elements are arranged on the second side, wherein said at least two of the parasitic radiative elements arranged on the first side comprise a first parasitic radiative element having a longitudinal axis substantially parallel to the first axis a second parasitic radiative element having a longitudinal axis substantially perpendicular to the first axis, and wherein said at least another two of the parasitic radiative elements arranged on the second side comprise a first parasitic radiative element having a longitudinal axis substantially parallel to the first axis and a second parasitic radiative element having a longitudinal axis substantially perpendicular to the first axis; and wherein the ground plane comprises a plurality of separate slots, each slot having a middle section connected to two opposite end sections, and said plurality of slots comprise a first slot and a second slot, wherein the middle section of the first slot has a longitudinal axis substantially parallel to the first axis and the middle section of the second slot has a longitudinal axis substantially parallel to the first axis; and wherein the first feed line comprises a longitudinal section substantially perpendicular to the first axis, one end of the longitudinal section adjacent to the middle section of the first slot, and the second feed line comprises a longitudinal section substantially parallel to the first axis, one end of the longitudinal section adjacent to the middle section of the second slot. The primary radiative element can be square or rectangular is shape, so that the center frequency in the vertical polarization and the horizontal polarization can be the same or different.

In some embodiments, according to the present invention, two or more parasitic patches can be placed on each opposing side of the primary radiative element to enhance the H-plane coupling.

Moreover, the separation between the parasitic patches and the primary radiative element can be different from one side to the other in order to beam steer some sub-bands.

The primary radiative element may comprise two elongated radiative elements, one is for generating the vertical polarization and the other is for generating the horizontal polarization, depending on the orientation of the longitudinal axis of the elongated radiative elements and the orientation of H-shape slots placed below the elements.

The third aspect of the present invention is an antenna array having a plurality of microstrip patch antennas as described above.

The array can be one dimensional or two dimensional.

The fourth aspect of the present invention is an electronic device, comprising an antenna or antenna array as described above. The electronic device can be a communications device, such as an access point, a mobile terminal, a communicator device, a personal digital assistant, a gaming console or the like.

The present invention will become apparent upon reading the description taken in conjunction with FIGS. 1*a* to 9.

DETAILED DESCRIPTION OF THE INVENTION

In various embodiments of the present invention, one or more microstrip patches are used as primary radiators and a number of parasitic patches are arranged on each of the opposite sides of a primary radiator. In particular, at least two parasitic patches are arranged on each of the opposite sides of a primary radiator. As such, when the antenna is designed to provide dual-polarizations, at least one pair of parasite patches is used to shape the beamwidth of one polarization and another pair is used for shape the beamwidth of another polarization. An exemplary arrangement of the parasitic patches in relation to the primary radiator is shown in FIG. 1*a*.

Figure 1A:
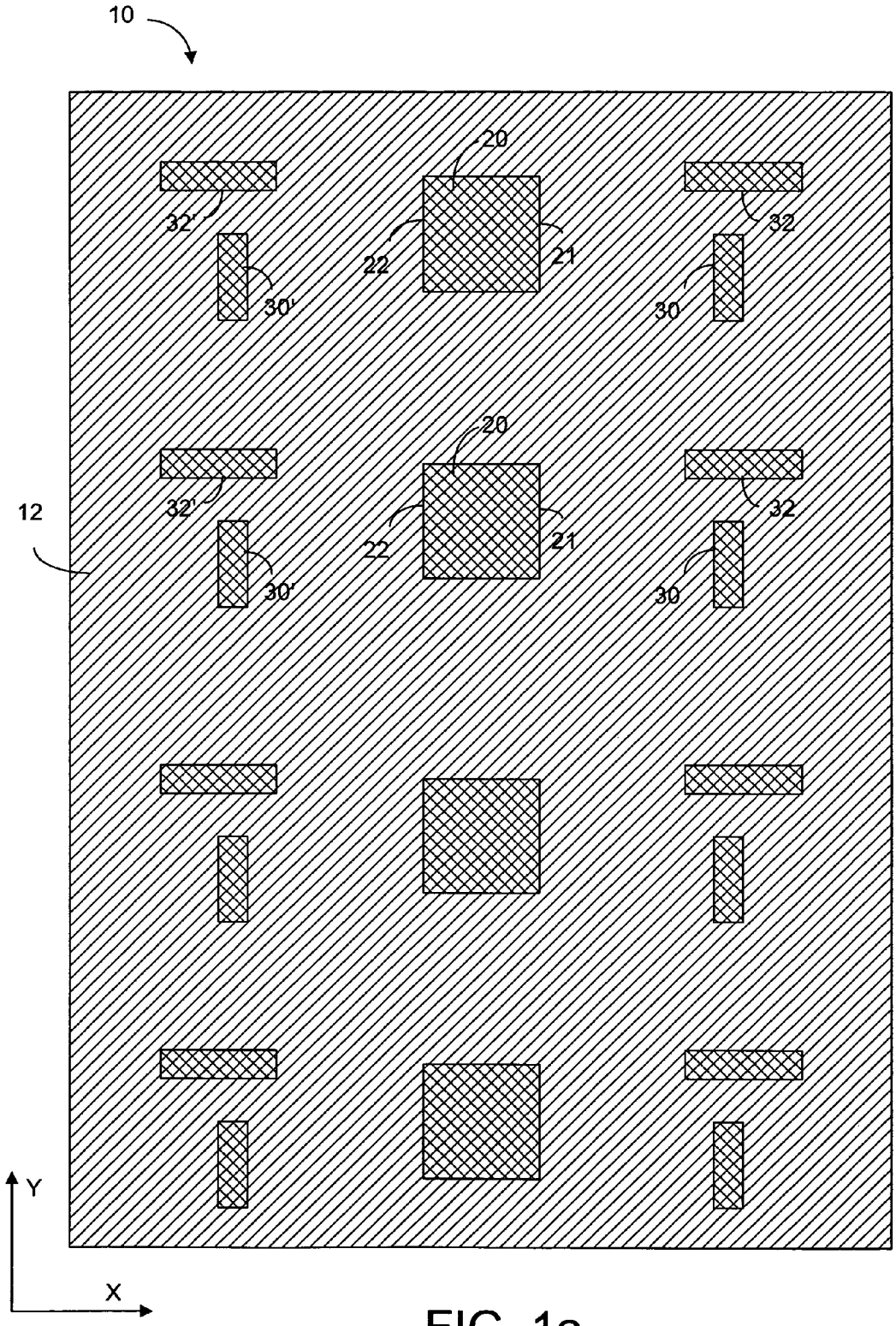
FIG. 1*a* shows the arrangement of electrically conducting patches on a radiating plane of a microstrip patch antenna array, according to one embodiment of the present invention.

FIG. 1*a* shows a radiating plane 10 (see FIG. 2) of a microstrip patch antenna array, according to one embodiment of the present invention. This embodiment is particularly suitable for use as a dual-polarized 120 degree sector patch antenna array for European Union (EU) regulations. For example, the average frequency range for backhaul connections in EU is 5.47-5.725 GHz, a single band to be covered by the diversity beam.

As shown in FIG. 1*a*, the radiating plane 10 comprises a substrate 12 and a plurality of electrically conducting patches arranged thereon. Among the electrically conducting patches, the patches 20 are the primary radiating patches and the patches 30, 32, 30' and 32' are parasitic patches. Each of the primary radiating patches 20 has a first side 21 and an opposing second side 22. For each primary radiating patch 20, two parasitic patches 30, 32 are arranged on the first side 21, and two parasitic patches 30', 32' are arranged on the second side 22. The parasitic patches 30, 32, 30', 32' are arranged lateral to the primary radiating patches 20.

Figure 1B:
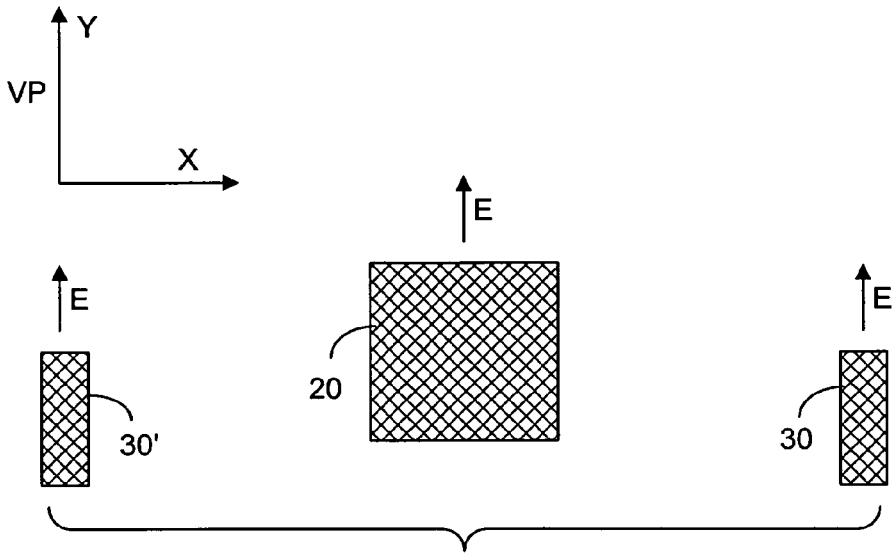
FIG. 1*b* shows the H-plane coupling between the primary radiating patch and some of the parasitic patches.
Figure 1C:
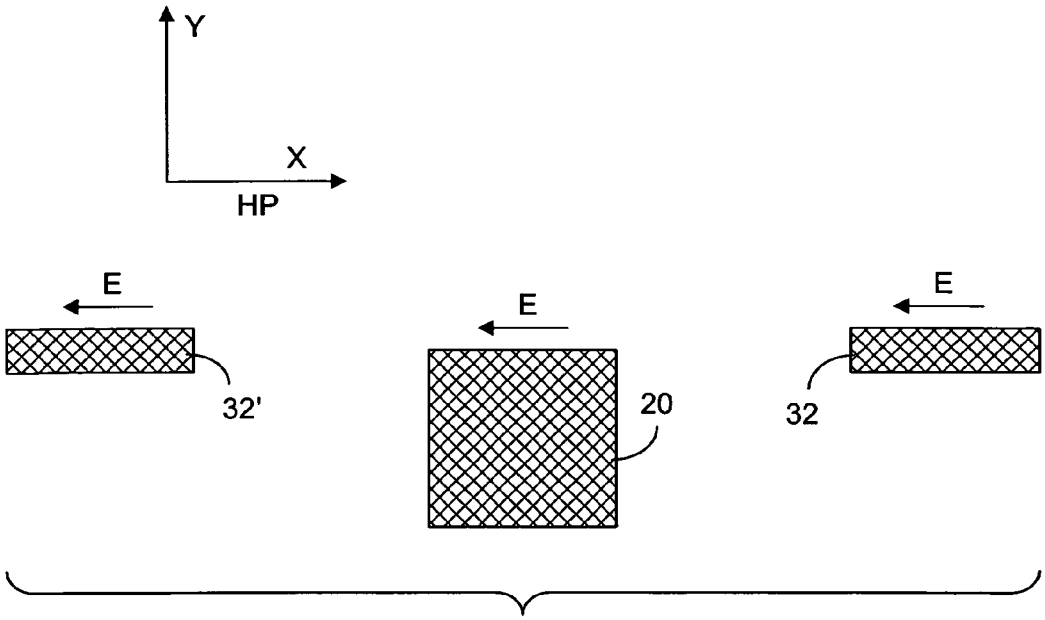
FIG. 1*c* shows the E-plane coupling between the primary radiating patch and some of the parasitic patches.

As shown in FIG. 1*a*, the primary radiating patches 20 are aligned along the Y axis. The primary radiating patch 20 is substantially square and is used to generate vertical polarization (VP) and horizontal polarization (HP) radiating patterns at substantially the same frequency which is primarily determined by the dimensions of the patch. In the arrangement as shown in FIG. 1*a*, the VP radiating pattern along the Y axis is altered mainly by the parasitic patches 30, 30' through H-plane (magnetic field) coupling, as shown in FIG. 1*b*. The HP radiating pattern along the X axis is altered mainly by the parasitic patches 32, 32' through E-plane (electric field) coupling, as shown in FIG. 1*c*. It should be noted that the primary radiating patch 20 can be a non-square, such as rectangular, patch if separate frequency bands for the different polarizations are required.

Figure 2:
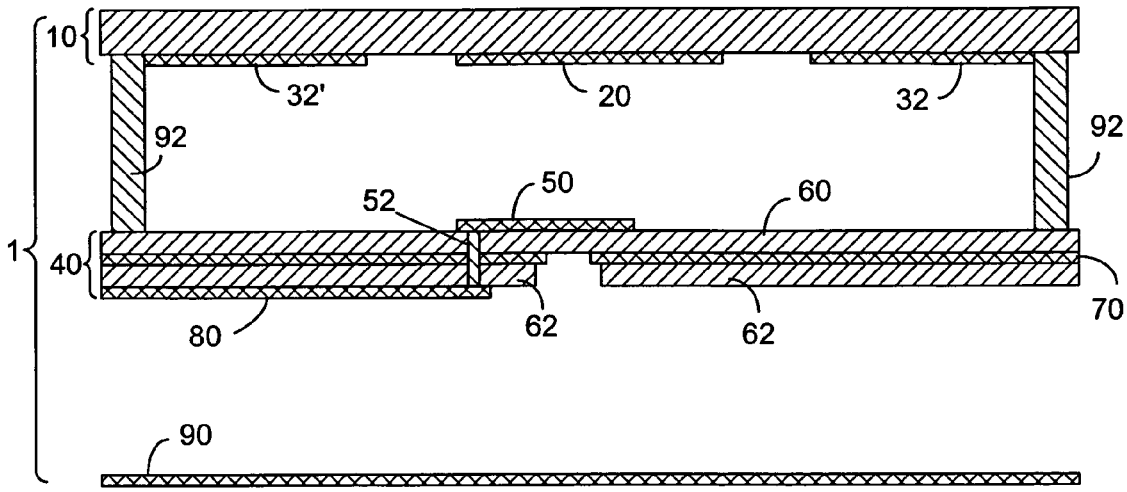
FIG. 2 shows a side-view of the microstrip patch antenna, according to one embodiment of the present invention.

The primary radiating patches 20 generate the radiating pattern when the feeds are driven. FIG. 2 shows the antenna arrangement, according to one embodiment of the present invention. As shown in FIG. 2, the antenna 1 has a layer structure 40 spaced from the radiating plane 10 by an air gap or a foam slab or other low loss dielectric layer. The layer structure 40 comprises a feed plane and a ground plane 70 with a plurality of H-shaped slots. The feed plane is constructed using a multilayer technique such that the feed 50 is located on a dielectric substrate 60 and the feed 80 is located on a different dielectric substrate 62. The feeds 50 and 80 are electrically connected through a via 52. The ground plane 70 with H-shaped slots is located between the substrates 60 and 62. Optionally, a separate ground plane 90 is used as a reflecting ground plane.

Figure 3B:
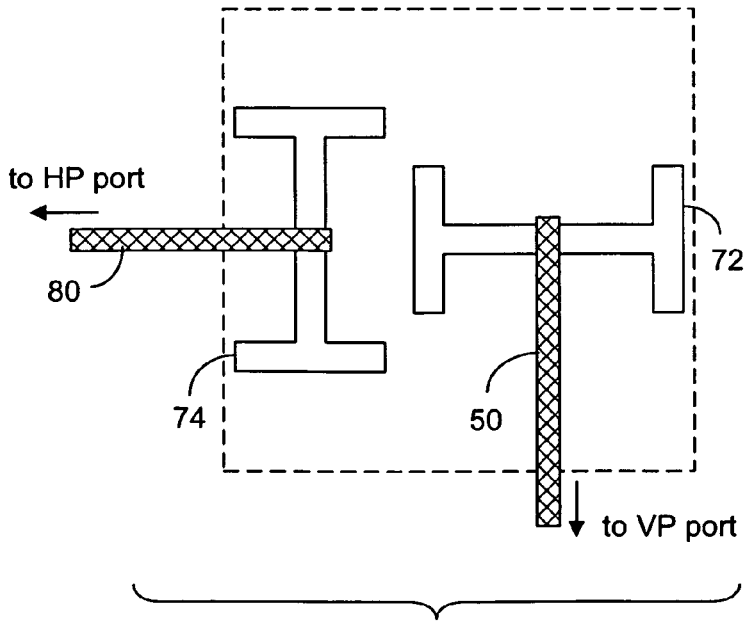
FIG. 3*b* shows the spatial relationship between the feeds and the H-shaped slots.
Figure 3A:
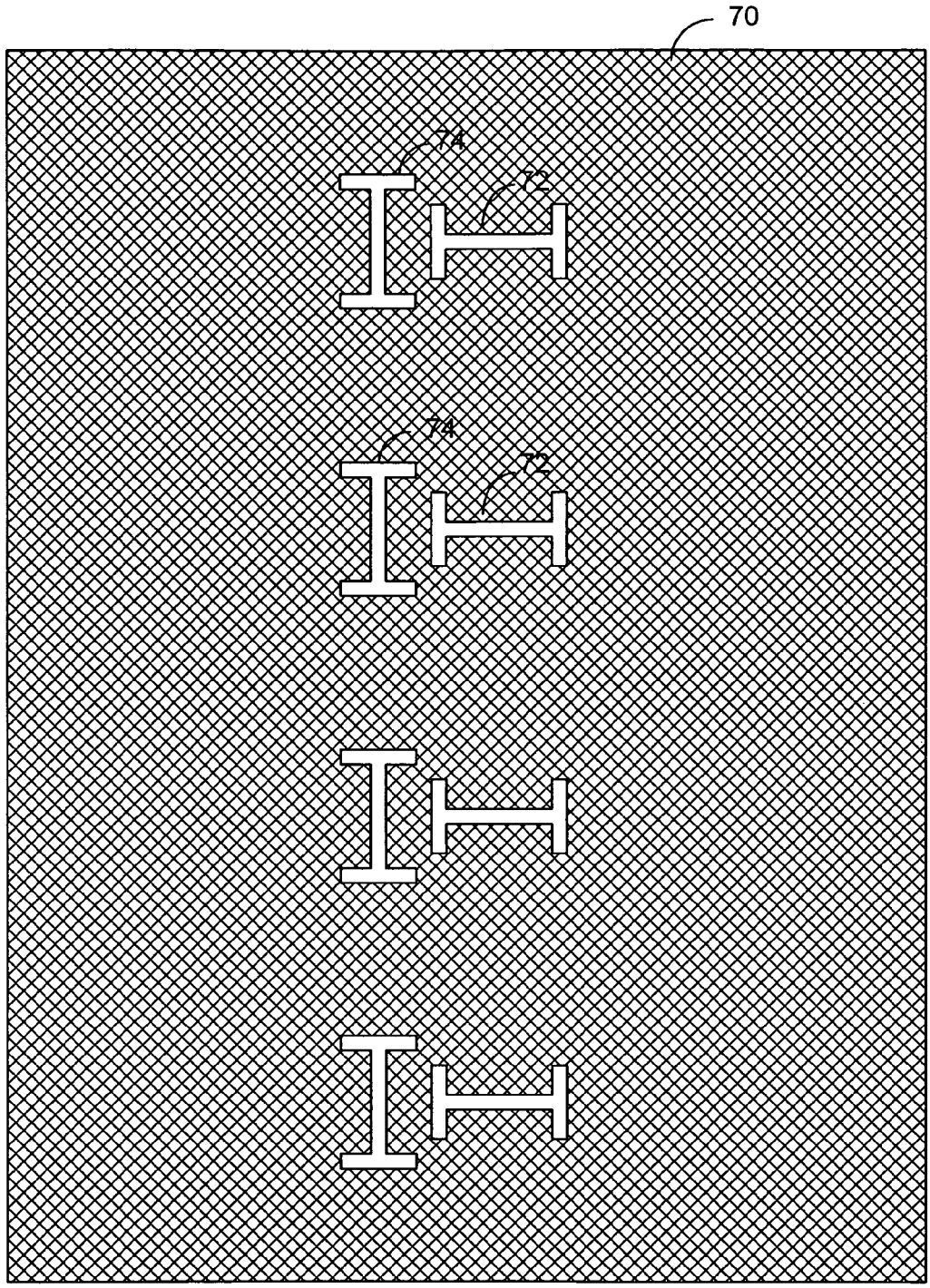
FIG. 3*a* shows the arrangement of the H-shaped slots on a ground plane adjacent to the feed plane, according to one embodiment of the present invention.

FIG. 3*a* shows an exemplary ground plane. As shown in FIG. 3*a*, the ground plane 70 has a plurality of H-shaped slot pair (72, 74), each pair corresponding to a primary radiating patch 20 on the radiating plane 10 (see FIG. 2), the H-shaped slots 72, 74 in a pair are arranged in a "T" configuration in order to provide isolation to the ports connected to the feed lines 52 and 80, as shown in FIG. 3*b*. The dashed line shows the location of the corresponding primary radiating patch 20 in the radiating plane.

Since the placement of the parasitic patches 30, 30' relative to the associated primary radiating patch 20 is independently of the placement of the parasitic patches 32, 32' relative to the same primary radiating patch 20, the adjustment on the VP radiating pattern can be different from the adjustment of the HP pattern. In general, in order to widen the half-power beamwidth (HPBW) of the main beam in the radiating pattern, the parasitic patches are placed relative to the primary radiating patch such that the currents in the primary radiating patch and the induced currents in the associated parasitic patches are in opposite phase at some operating frequency. In order to narrow the beamwidth of main beam, the currents in the primary radiating patch and the induced currents in the associated parasitic patches are in same phase at some operating frequency. By controlling the mutual coupling between adjacent patches of the same orientation, the radiation properties can be further optimized. When separate parasitic patch pairs are used to adjust the radiation pattern of different polarizations, it is possible to generate narrow or wide beams on specific frequency bands around the center frequency of the fed patch. It is also possible to steer some specific beams away from the boresight by introducing uneven current distribution along the patch principal axes (horizontal axis and/or vertical axis, for example).

Figure 4:
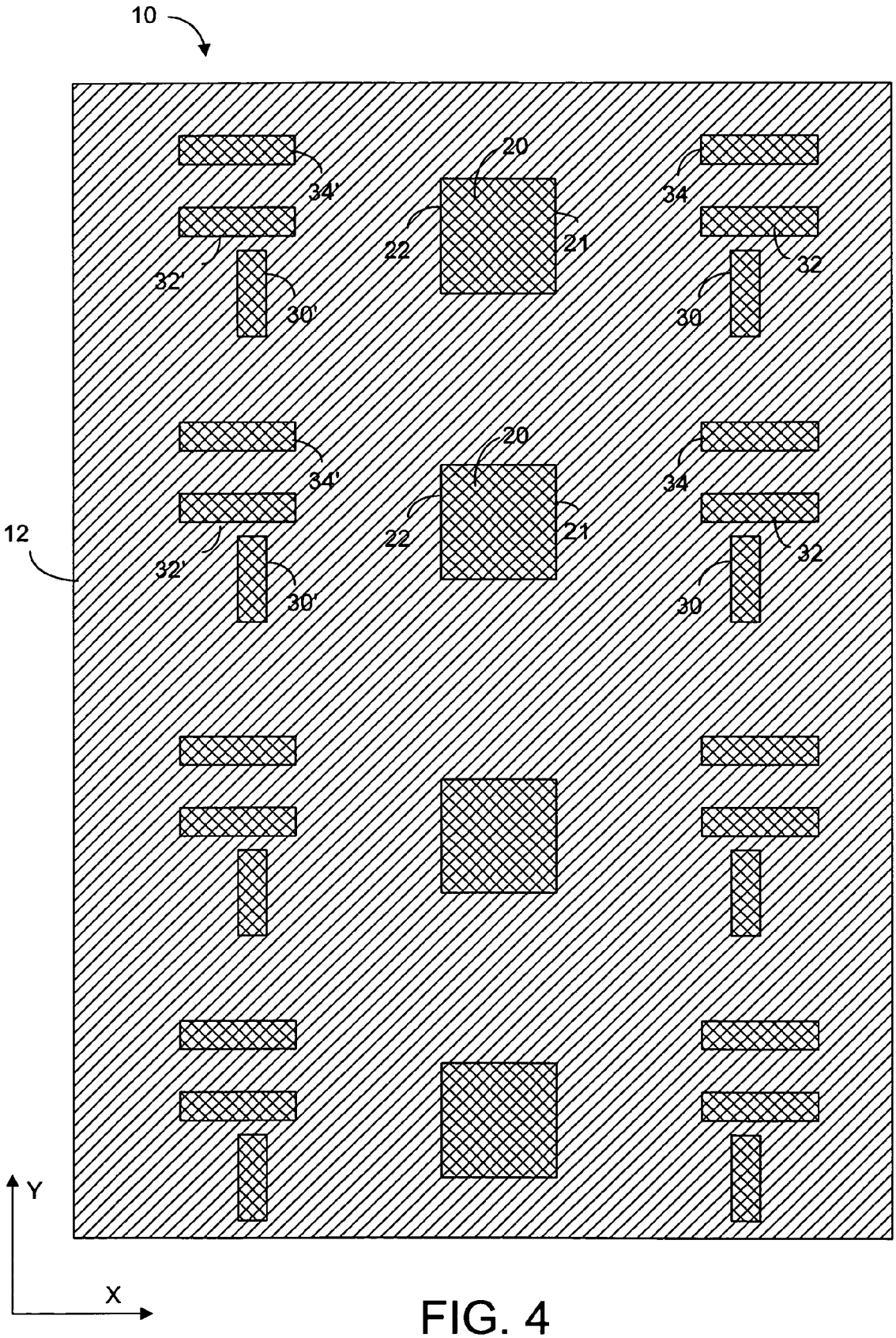
FIG. 4 shows the arrangement of electrically conducting patches on a radiating plane of a microstrip patch antenna array, according to another embodiment of the present invention.

FIG. 4 shows a microstrip patch antenna array, according to another embodiment of the present invention. As shown in FIG. 4, for each primary radiating patch 20, three parasitic patches 30, 32, 34 are arranged on the first side 21, and three parasitic patches 30', 32', 34' are arranged on the second side 22. This embodiment is particularly suitable for use as a dual-polarized 120 degree sector patch antenna array for U.S. regulations. For example, the diversity beam should cover 5.25-5.725 GHz and 5.75-5.825 GHz average frequency range for backhaul connections in EU is 5.47-5.725 GHz. As shown in FIG. 4, two adjacent parasitic patches (32, 34, or 32', 34') of the same orientation are placed on each side of the primary radiating patch 20 to adjust the horizontal polarization through E-plane coupling. With the shapes, sizes and separation of the adjacent parasitic patches being adjustable, a substantially symmetrical current distribution over the desired frequency can be achieved.

Figure 5:
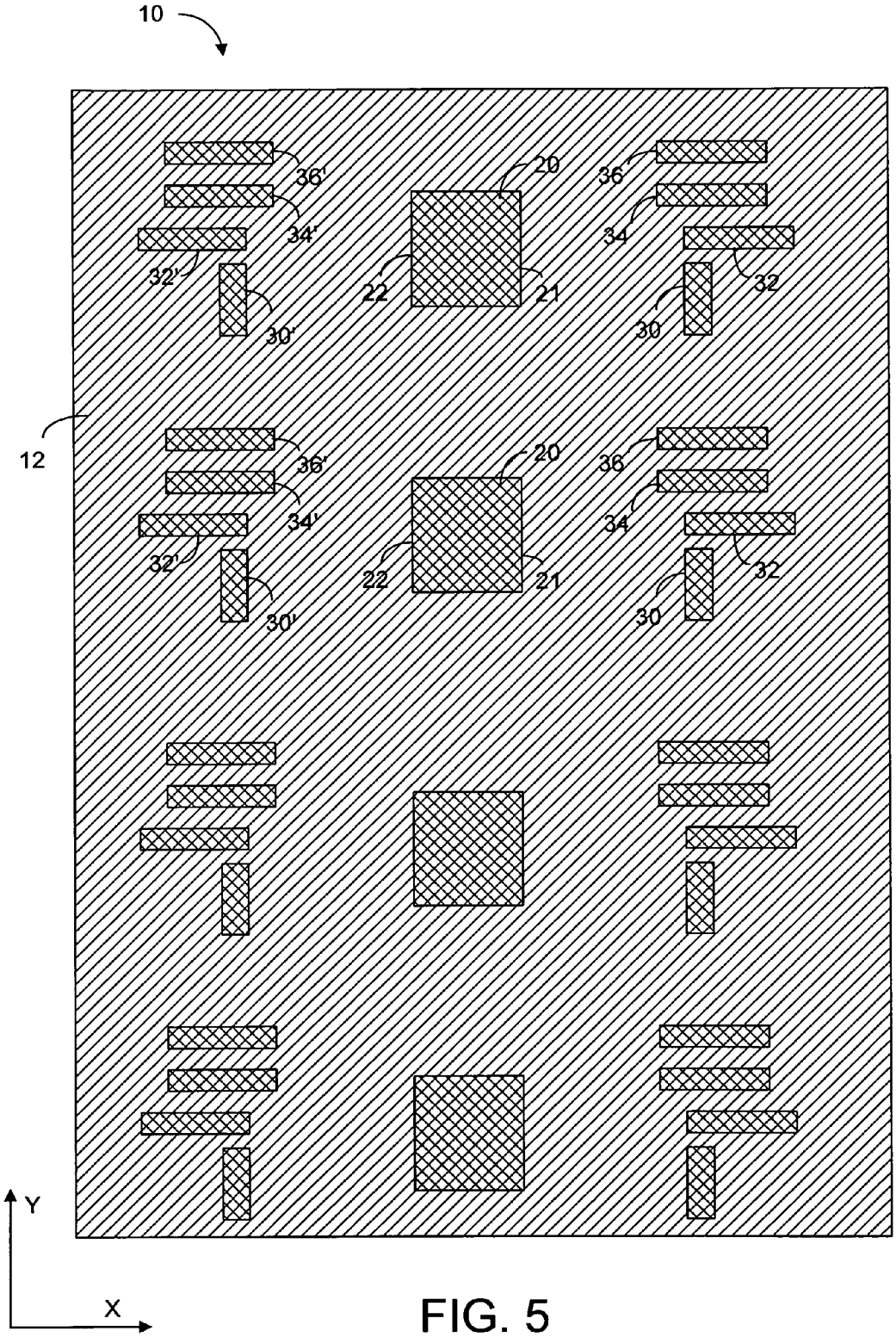
FIG. 5 shows the arrangement of electrically conducting patches on a radiating plane of a microstrip patch antenna array, according to a different embodiment of the present invention.

FIG. 5 shows a microstrip patch antenna array, according to a different embodiment of the present invention. As shown in FIG. 5, for each primary radiating patch 20, four parasitic patches 30, 32, 34, 36 are arranged on the first side 21, and four parasitic patches 30', 32', 34', 36' are arranged on the second side 22. Three adjacent parasitic patches (32, 34, 36 or 32', 34', 36') of the same orientation are placed on each side of the primary radiating patch 20 to adjust the horizontal polarization through E-plane coupling.

Figure 6A:
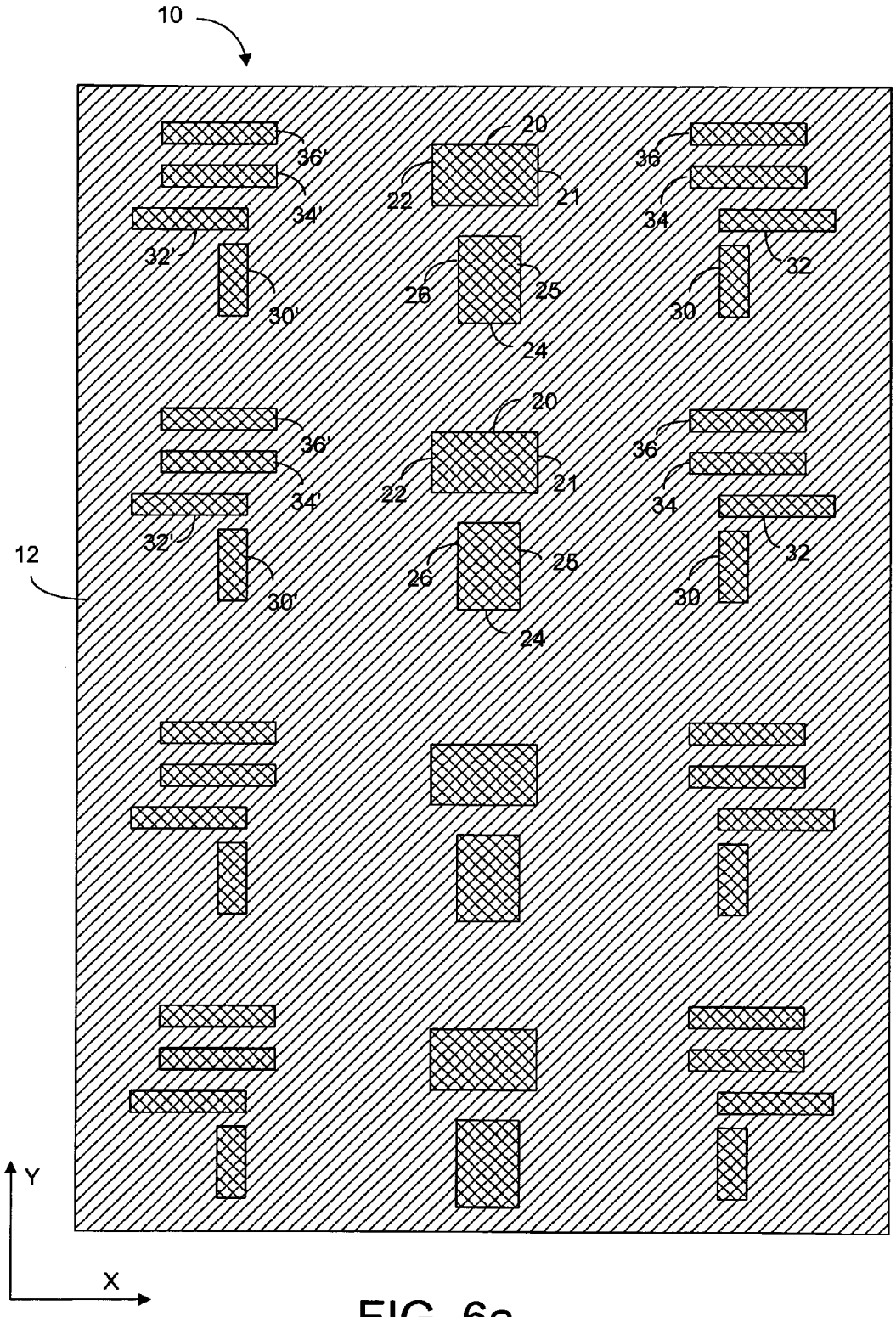
FIG. 6*a* shows the arrangement of electrically conducting patches on a radiating plane of a microchip patch antenna array, according to yet another embodiment of the present invention.
Figures 6B, 6C:
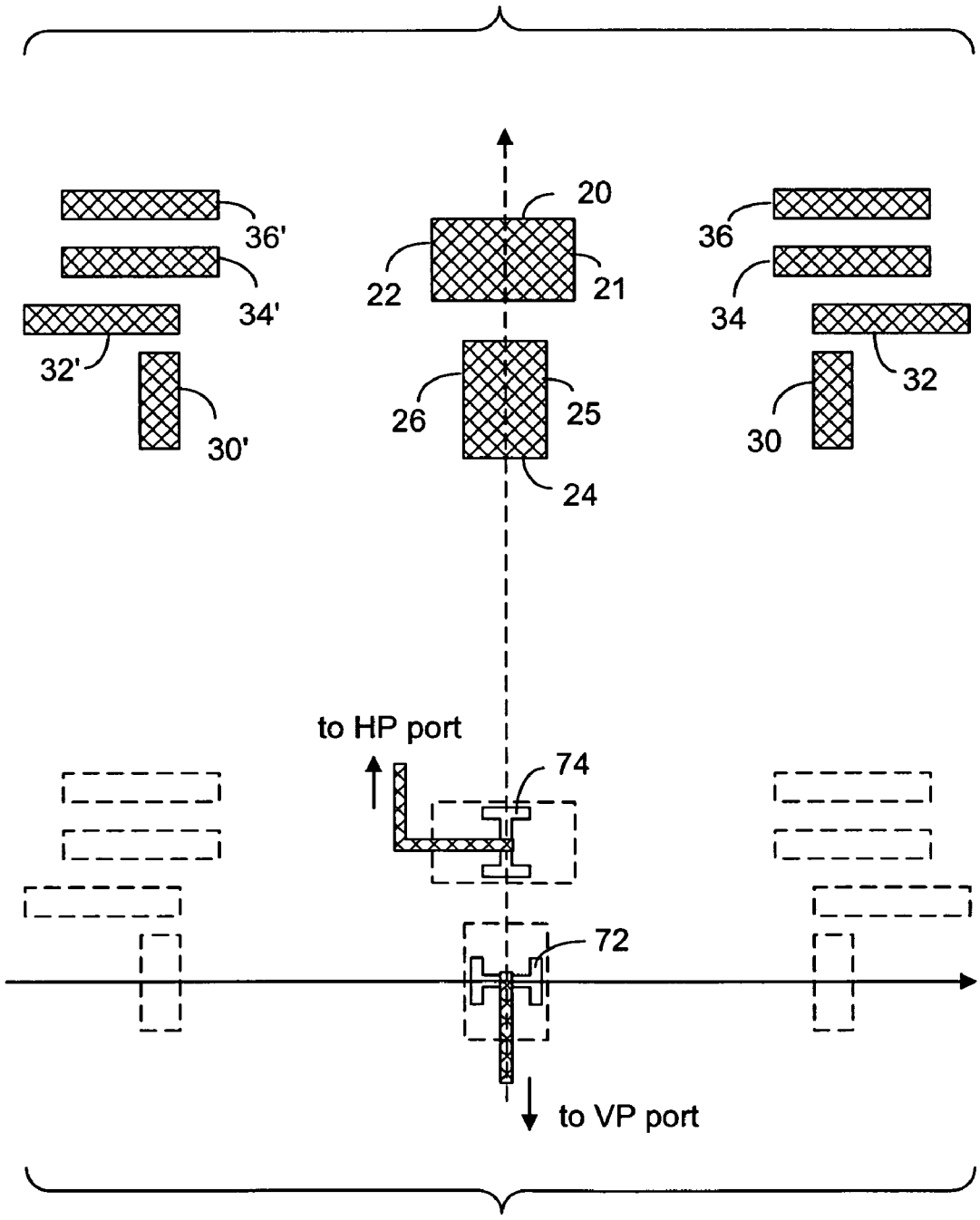
FIG. 6*b* shows the spatial relationship between two separate vertical and horizontal polarized elements as parts of the interlaced antenna array as shown in FIG. 6*a*.
FIG. 6*c* shows the spatial relationship between the H-shaped slots and the primary radiating patches in the arrangement of FIG. 6*a*.

FIG. 6*a* shows a microstrip patch antenna array, according to yet another embodiment of the present invention. In this embodiment, the primary radiating patch is divided into two separate patches 20 and 24. As shown in FIG. 6*b*, the primary radiating patch 20 and the parasitic patches 32, 34, 36, 32', 34' and 36' are used for the horizontal polarization, with parasitic patches 32, 34 and 36 being located on the first side 21 and patches 32', 34' and 36' being located on the second side 22. The primary radiating patch 24 and the parasitic patches 30 and 30' are used for the vertical polarization, with parasitic patch 30 being located on the first side 25 and the parasitic patch 30' being located on the second side 26. FIG. 6*c* shows the arrangements of the feed plane and the H-shaped slots in the ground plane (see FIG. 2, for example). The dashed lines show the locations of the corresponding primary patches and the parasitic patches on the radiating plane. In the embodiment as illustrated in FIGS. 6*a*-6*b*, the antenna uses interlaced separate vertical and horizontal polarized elements in order to achieve beamwidth control with full coverage of the 4.9-5.825 GHz frequency band with both HP and VP polarizations.

With two polarizations in orthogonal directions, the antenna can be used to provide dual-linear polarizations or circular polarizations depending on port connections. For example, a dual-linearly polarized antenna can be turned into a circularly-polarized antenna by feeding the polarization ports with the same signal but with 90 degree phase shift. The orientation of the circular polarization (left-handed or right-handed) depends on the phase relationship between the ports.

In sum, the half-power beamwidths (HPBW) of two orthogonal polarizations from a microstrip patch antenna can be widened or narrowed in desired frequency bands around the center frequency of the antenna. The result is a wideband or multiband antenna with desired beamwidth characteristics. The microstrip patch antenna arrangement, according to various embodiments of the present invention can achieve a single-polarized or dual-polarized antenna, or an interlaced array consisting of multiple differently polarized antennas. Circular polarization is possible by suitably phasing the dual-polarized antenna feeds. According to various embodiments of the present invention, both E-plane (electric field) and H-plane (magnetic field) coupled parasitic patches are usable. The beamwidth widening by using parasitic patches works when the patch separation is chosen to be so that the currents in the primary radiator and the induced currents in the parasitics are in opposite phase at some operating frequency (preferably mid-band). The far-field radiation pattern from such a current distribution has certain main beam ripple which can be controlled by the strength of the coupling, i.e., size and location of the parasitic patch. A smaller patch has lower coupling factor and less main beam ripple for the same patch separation. Further, when the coupling factor between the primary radiator and the parasitic patches is low, the impedance bandwidth of the primary radiator remains unaffected. If the parasitic patch separation is chosen so that the induced currents are in-phase with the primary radiator, the resulting beam will be narrower than the primary radiators own beam in the case of no parasitic patches. The parasitic patches are shaped so that they are active with only a single linear polarization (such as vertical or horizontal polarizations in an exemplary embodiment). This ensures that good polarization isolation is maintained, and independent control of both polarizations is possible.

The present invention uses multiple parasitic patches ('sticks') per polarization, working together to form the desired beamwidth characteristics with frequency. The active bandwidth of a parasitic patch is a function of its size and separation from the main fed patch. There is also strong coupling between adjacent parasitic patches of the same orientation which have an effect on the current distribution. By controlling the mutual coupling between adjacent patches of the same orientation, the radiation properties can be further optimized. Typically, the parasitic patches are placed along the polarization axes and can be offset from the main patch principal axis. A different number of parasitic patches may be needed to cover the same frequency range with different polarizations. The reason is the different characteristics of E- and H-plane coupling. Typically, H-plane coupling is stronger than E-plane coupling when the patches are close to each other but it is weaker when the patch separation is increased. H-plane coupling can be used to get the widest beamwidths.

Thus, the method, according to various embodiments of the present invention, comprises:

providing a radiative plane in an antenna, wherein the radiative plane comprises a primary radiative element and a plurality of separate parasitic radiative elements spaced from the primary radiative element, the primary radiative element having a first side and an opposing second side, the first and second sides parallel to a first axis, and wherein at least two of the parasitic radiative elements are arranged on the first side and at least another two of parasitic radiative elements are arranged on the second side, wherein said at least two of the parasitic radiative elements arranged on the first side comprise a first parasitic radiative element having a longitudinal axis substantially parallel to the first axis and a second parasitic radiative element having a longitudinal axis substantially perpendicular to the first axis, and wherein said at least another two of the parasitic radiative elements arranged on the second side comprise a third parasitic radiative element having a longitudinal axis substantially parallel to the first axis and a fourth parasitic element having a longitudinal axis substantially perpendicular to the first axis;

arranging a ground plane spaced from the radiative plane, wherein the ground plane comprises a plurality of separate slots, each slot having a middle section connected to two opposite end sections, and said plurality of slots comprise a first slot and a second slot, wherein the middle section of the first slot has a longitudinal axis substantially parallel to the first axis and the middle section of the second slot has a longitudinal axis substantially parallel to the first axis; and arranging a plurality of feed lines adjacent to but electrically isolated from the ground plane, wherein said plurality of feed lines comprise a first feed line and a second feed line, and wherein the first feed line comprises a longitudinal section substantially perpendicular to the first axis, one end of the longitudinal section adjacent to the middle section of the first slot, and the second feed line comprises a longitudinal section substantially parallel to the first axis, one end of the longitudinal section adjacent to the middle section of the second slot.

According to various embodiments of the present invention, the first parasitic element is spaced from the primary radiative element by a first distance and the third parasitic element is spaced from the primary radiative element by a second distance substantially equal to or different from the first distance, and the third parasitic element is spaced from the primary radiative element by a third distance and the fourth parasitic element is spaced from the primary radiative element by a fourth distance substantially equal to or different from the third distance.

In some embodiments of the present invention, said at least two of the parasitic radiative elements arranged on the first side further comprise a fifth parasitic radiative element arranged between the first radiative element and second parasitic radiative element, the fifth parasitic radiative element having a longitudinal axis substantially perpendicular to the first axis; and said at least another two of the parasitic radiative elements arranged on the second side further comprise a sixth parasitic radiative element arranged between the third radiative element and fourth parasitic radiative element, the sixth parasitic radiative element having a longitudinal axis substantially perpendicular to the first axis.

The microstrip patch antenna, according to various embodiments of the present invention, comprises:

a radiative plane comprising:

a primary radiative element and a plurality of separate parasitic radiative elements spaced from the primary radiative element, the primary radiative element having a first side and an opposing second side, the first side and the second side substantially parallel to a first axis, and wherein at least two of the parasitic radiative elements are arranged on the first side and at least another two of parasitic radiative elements are arranged on the second side, wherein said at least two of the parasitic radiative elements arranged on the first side comprise a first parasitic radiative element having a longitudinal axis substantially parallel to the first axis a second parasitic radiative element having a longitudinal axis substantially perpendicular to the first axis, and wherein said at least another two of the parasitic radiative elements arranged on the second side comprise a first parasitic radiative element having a longitudinal axis substantially parallel to the first axis and a second parasitic radiative element having a longitudinal axis substantially perpendicular to the first axis;

a ground plane spaced from the radiative plane, the ground plane comprising a plurality of separate slots, each slot having a middle section connected to two opposite end sections, and said plurality of slots comprise a first slot and a second slot, wherein the middle section of the first slot has a longitudinal axis substantially parallel to the first axis and the middle section of the second slot has a longitudinal axis substantially parallel to the first axis;

a first feed line comprising a longitudinal section substantially perpendicular to the first axis, one end of the longitudinal section adjacent to the middle section of the first slot; and a second feed line comprising a longitudinal section substantially parallel to the first axis, one end of the longitudinal section adjacent to the middle section of the second slot.

In some embodiments, said at least two of the parasitic radiative elements arranged on the first side further comprise a fifth parasitic radiative element arranged between the first radiative element and second parasitic radiative element, the fifth parasitic radiative element having a longitudinal axis substantially perpendicular to the first axis; and said at least another two of the parasitic radiative elements arranged on the second side further comprise a sixth parasitic radiative element arranged between the third radiative element and fourth parasitic radiative element, the sixth parasitic radiative element having a longitudinal axis substantially perpendicular to the first axis.

A plurality of such microstrip patch antennas can be arranged into a one-dimensional array or a two-dimensional array.

The microstrip patch antenna or antenna array can be used in an electronic device, such as an access point, a mobile terminal, a communicator device, a person digital assistant or the like.

The proximity-coupled microstrip patch antennas, according to various embodiments of the present invention, typically have large impedance bandwidths. The parasitic patches are used mainly to shape the radiated beam and not to improve the impedance bandwidth of the antenna. The application has been verified by electromagnetic simulations using the method of moments (MoM) and measurements on constructed prototypes. It is also possible to use the method with many kinds of other microstrip patch antennas. Some non-limiting examples include aperture-coupled, slot-coupled, and probe-fed patch antennas. The use of multiband primary radiators is also possible. Two variants of the antenna for a 120 deg horizontal sector have been described. The difference is in the operating band of the HP (backhaul diversity) beam. For European Union (EU) markets, a single band of 5.47-5.725 GHz needs to be covered by the diversity beam. For United States (US), the diversity beam should cover 5.25-5.35 GHz and 5.75-5.825 GHz bands. Also described is an interlaced array of separate HP and VP antenna elements for 120 deg sector which can be used to provide full coverage of the 4.9-5.825 GHz with both polarizations is demonstrated.

Figure 7:
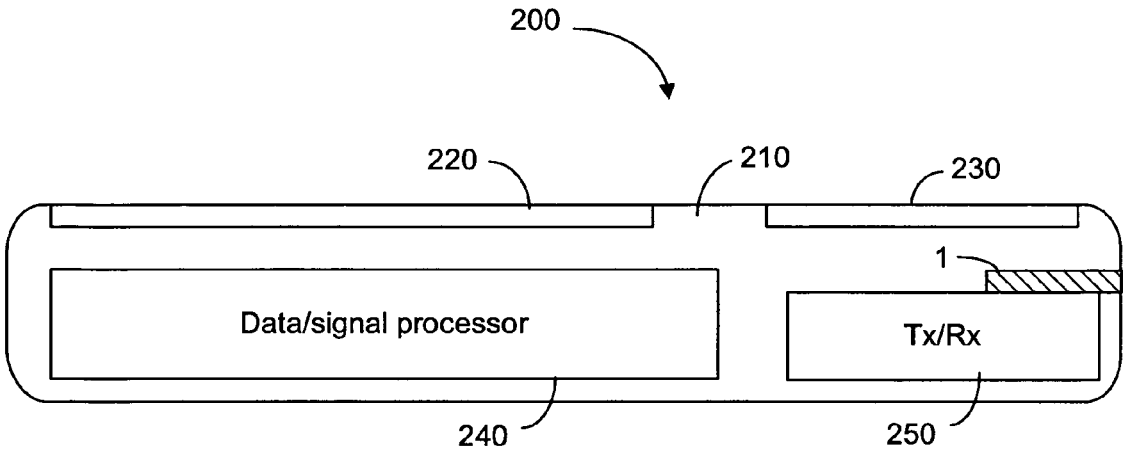
FIG. 7 is a block diagram showing a communication device having the microstrip patch antenna, according to various embodiments of the present invention.

With the present invention, a dual-polarized multiband antenna array can be made relatively small in size compared to an array based on separate V- and H-polarized antennas. The microstrip patch array antennas, according to various embodiments of the present invention, can be used in an access point and a communication device, such as a mobile terminal 200 as shown in FIG. 7. As shown in FIG. 7, the mobile terminal 200 comprises a device body 210 to house various device parts, including a microstrip patch array antenna 1, a keypatch 220, a display 230, a transceiver 250 operatively connected to the antenna 1 to transmit or receive communication signals and data. The mobile terminal 200 also comprises a data/signal processor to process the received signals and data, the signals and data to be transmitted and the input signals or data through the keypatch 220, for example.

Figure 8A:
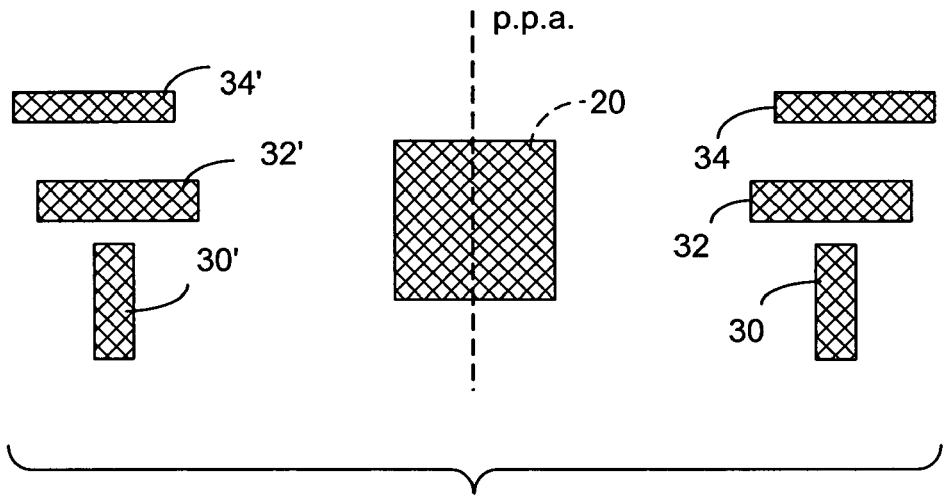
FIG. 8*a* shows the arrangement of the parasitic patches in relation to the primary radiative patch, according to one embodiment of the present invention.

It should be noted that the microstrip patch antenna array 10, according to various embodiments of the present invention, typically has a patch principal axis (p.p.a.) as shown in the FIG. 8*a*. In some embodiments of the present invention, the parasitic patches 30, 32, 34 and the parasitic patches 30', 32', 34' are arranged on opposite sides of the primary radiating patch 20 in a symmetrical fashion in reference to the patch principal axis. However, the parasitic patches 32, 32' can be different in size from the parasitic patches 34, 34'. For example, the width of the parasitic patches 32, 32' is smaller than the width of the parasitic patches 34, 34'. Likewise, the length of the parasitic patches 32, 32' can also be different from the length of the parasitic patches 34, 34'.

Figure 8B:
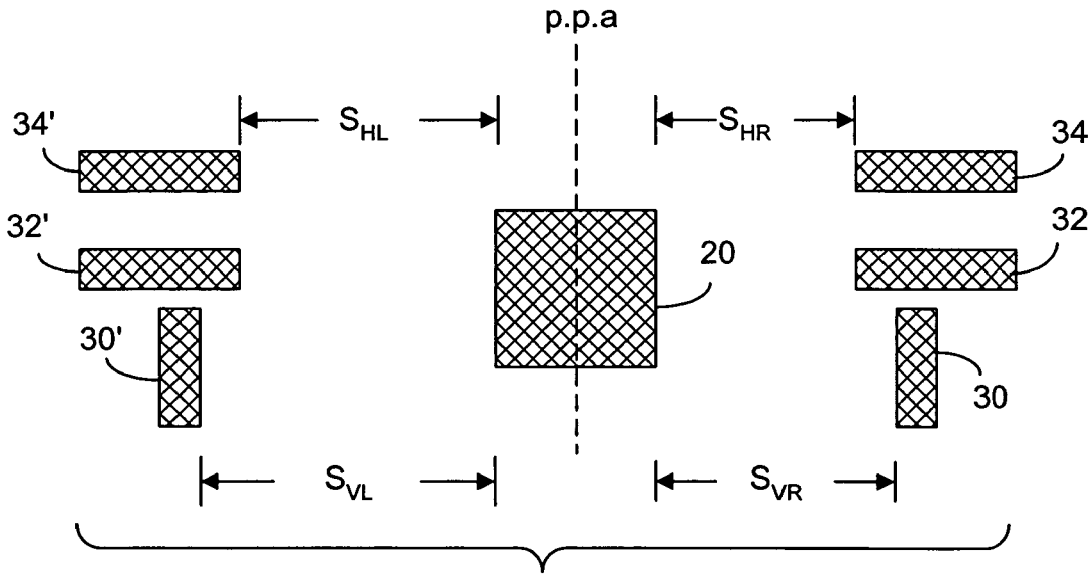
FIG. 8*b* shows the arrangement of the parasitic patches in relation to the primary radiative patch, according to another embodiment of the present invention.

In a different embodiment of the present invention, the parasitic patches 30, 32, 34 and the parasitic patches 30', 32', 34' are arranged on opposite sides of the primary radiating patch 20 in a non-symmetrical fashion in reference to the patch principal axis (p.p.a.). As shown in FIG. 8*b*, the separation $S_{VR}$ between the parasitic patch 30 and the primary patch 20 is different from the separation $S_{VL}$ between the parasitic patch 30' and the primary patch 20. Likewise, the separation $S_{HR}$ between the parasitic patches 32, 34 and the primary patch 20 is different from the separation $S_{HL}$ between the parasitic patches 32', 34' and the primary patch 20. As such, the current distribution along the patch principal axis is uneven. By introducing the uneven current distribution along the patch principal axis, it is possible to beam steer some sub-bands of the antenna radiation pattern. A practical use of this arrangement includes the use of beam steering to connect to several adjacent access points or radio links with different frequency bands in a certain sector. For example, one could use the 4.9 GHz band for communication with another access point located left from the current access point boresight, the 5.8 GHz band for communication with yet another access point located right from the boresight, and the 5.35 GHz band to an access point with the same boresight.

Figure 9:
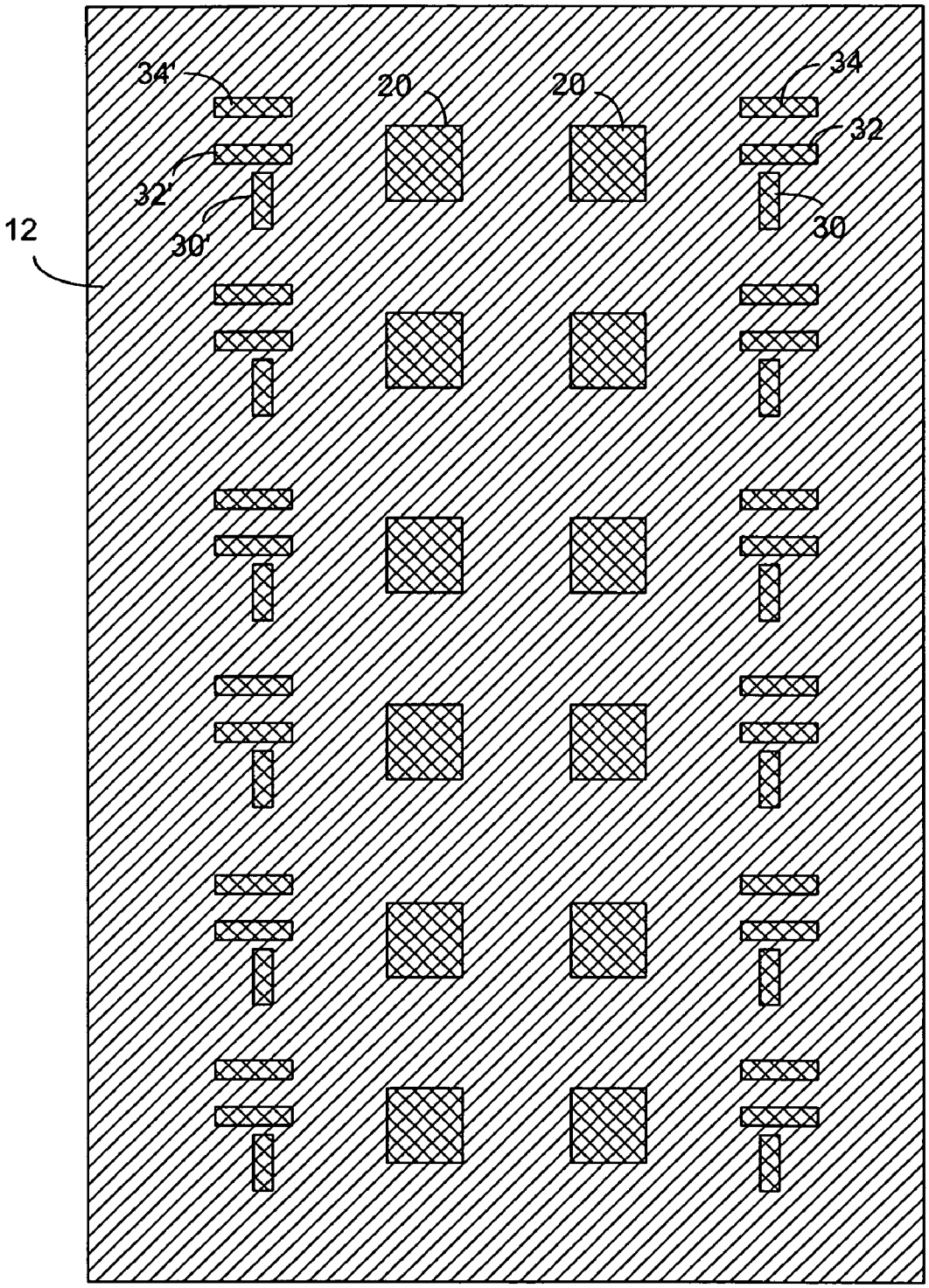
FIG. 9 shows a two-dimensional antenna array using the microstrip patch antennas, according to various embodiments of the present invention.

The microstrip patch antennas, according to various embodiments of the present invention, can be arranged in a one-dimensional array as shown in FIGS. 1*a*, 4 and 6*a*. It is also possible to arrange the patch antennas in a two-dimensional array as shown in FIG. 9. In such a two-dimensional array, as shown in FIG. 9, each of the primary radiating patch 20 is associated with a pair of H-shaped slots and feed lines as shown in FIG. 3*b*.

Thus, although the present invention has been described with respect to one or more embodiments thereof, it will be understood by those skilled in the art that the foregoing and various other changes, omissions and deviations in the form and detail thereof may be made without departing from the scope of this invention.

What is claimed is:

1. A method, comprising:

providing a radiative plane in an antenna, wherein the radiative plane comprises a primary radiative element and a plurality of separate parasitic radiative elements spaced from the primary radiative element, the primary radiative element having a first side and an opposing second side, the first and second sides parallel to a first axis, and wherein at least two of the parasitic radiative elements are arranged on the first side and at least another two of parasitic radiative elements are arranged on the second side, wherein said at least two of the parasitic radiative elements arranged on the first side comprise a first parasitic radiative element having a longitudinal axis substantially parallel to the first axis and a second parasitic radiative element having a longitudinal axis substantially perpendicular to the first axis, and wherein said at least another two of the parasitic radiative elements arranged on the second side comprise a third parasitic radiative element having a longitudinal axis substantially parallel to the first axis and a fourth parasitic element having a longitudinal axis substantially perpendicular to the first axis;

arranging a ground plane spaced from the radiative plane, wherein the ground plane comprises a plurality of separate slots, each slot having a middle section connected to two opposite end sections, and said plurality of slots comprise a first slot and a second slot, wherein the middle section of the first slot has a longitudinal axis substantially parallel to the first axis and the middle section of the second slot has a longitudinal axis substantially parallel to the first axis; and arranging a plurality of feed lines adjacent to but electrically isolated from the ground plane, wherein said plurality of feed lines comprise a first feed line and a second feed line, and wherein one end of the first feed line is located adjacent to the middle section of the first slot, and one end of the second feed line is located adjacent to the middle section of the second slot.

2. The method of claim 1, wherein the first feed line comprises a longitudinal section having said one end located adjacent to the middle section of the first slot, and the second feed line comprises a longitudinal section having said one end located adjacent to the middle section of the second slot.

3. The method of claim 1, wherein said at least two of the parasitic radiative elements arranged on the first side further comprise a fifth parasitic radiative element arranged between the first parasitic radiative element and second parasitic radiative element, the fifth parasitic radiative element having a longitudinal axis substantially perpendicular to the first axis, and wherein said at least another two of the parasitic radiative elements arranged on the second side further comprise a sixth parasitic radiative element arranged between the third parasitic radiative element and fourth parasitic radiative element, the sixth parasitic radiative element having a longitudinal axis substantially perpendicular to the first axis.

4. The method of claim 1, wherein the primary radiative element is substantially square in shaped.

5. The method of claim 1, wherein the primary radiative element is substantially rectangular in shape with one dimension different from another dimension.

6. The method of claim 1, wherein the primary radiative element comprises a first primary radiative element and a second radiative element arranged along the first axis, wherein the first primary radiative element has a longitudinal axis substantially parallel to the first axis and located between the first parasitic element and the third parasitic element, and the second primary radiative element has a longitudinal axis substantially perpendicular to the first axis and located between the second parasitic element and the fourth parasitic element, and wherein the first slot and the first primary radiative element are arranged along an axis substantially perpendicular to the first axis, and the second slot and the second primary radiative element are arranged along another axis substantially perpendicular to the first axis.

7. The method of claim 6, wherein the first primary radiative element, the second primary radiative element, the plurality of parasitic element, the plurality of slots and the plurality of feed lines are arranged as a group in the antenna, said method further comprising repeating the group along the first axis.

8. The method of claim 1, wherein the first parasitic element is spaced from the primary radiative element by a first distance and the third parasitic element is spaced from the primary radiative element by a second distance substantially equal to the first distance, and the third parasitic element is spaced from the primary radiative element by a third distance and the fourth parasitic element is spaced from the primary radiative element by a fourth distance substantially equal to the third distance.

9. The method of claim 1, wherein the first parasitic element is spaced from the primary radiative element by a first distance and the third parasitic element is spaced from the primary radiative element by a second distance different from the first distance, and the third parasitic element is spaced from the primary radiative element by a third distance and the fourth parasitic element is spaced from the primary radiative element by a fourth distance different from the third distance.

10. The method of claim 1, wherein the primary radiative element, the plurality of parasitic element, the plurality of slots and the plurality of feed lines are arranged as a group in the antenna, said method further comprising repeating the group along the first axis.

11. An antenna, comprising:

a radiative plane comprising:

a primary radiative element and a plurality of separate parasitic radiative elements spaced from the primary radiative element, the primary radiative element having a first side and an opposing second side, the first side and the second side substantially parallel to a first axis, and wherein at least two of the parasitic radiative elements are arranged on the first side and at least another two of parasitic radiative elements are arranged on the second side, wherein said at least two of the parasitic radiative elements arranged on the first side comprise a first parasitic radiative element having a longitudinal axis substantially parallel to the first axis a second parasitic radiative element having a longitudinal axis substantially perpendicular to the first axis, and wherein said at least another two of the parasitic radiative elements arranged on the second side comprise a third parasitic radiative element having a longitudinal axis substantially parallel to the first axis and a fourth parasitic radiative element having a longitudinal axis substantially perpendicular to the first axis;

a ground plane spaced from the radiative plane, the ground plane comprising a plurality of separate slots, each slot having a middle section connected to two opposite end sections, and said plurality of slots comprise a first slot and a second slot, wherein the middle section of the first slot has a longitudinal axis substantially parallel to the first axis and the middle section of the second slot has a longitudinal axis substantially parallel to the first axis;

a first feed line electrically isolated from the ground plane, one end of the first feed line located adjacent to the middle section of the first slot; and a second feed line electrically isolated from the ground plane, one end of the second feed line located adjacent to the middle section of the second slot.

12. The antenna of claim 11, wherein the first feed line comprises a longitudinal section having said one end located adjacent to the middle section of the first slot, and the second feed line comprises a longitudinal section having said one end located adjacent to the middle section of the second slot.

13. The antenna of claim 11, wherein each of the first slot and second slot comprises an H-shape slot.

14. The antenna of claim 11, wherein said at least two of the parasitic radiative elements arranged on the first side further comprise a fifth parasitic radiative element arranged between the first parasitic radiative element and second parasitic radiative element, the fifth parasitic radiative element having a longitudinal axis substantially perpendicular to the first axis, and wherein said at least another two of the parasitic radiative elements arranged on the second side further comprise a sixth parasitic radiative element arranged between the third parasitic radiative element and fourth parasitic radiative element, the sixth parasitic radiative element having a longitudinal axis substantially perpendicular to the first axis.

15. The antenna of claim 11, wherein the primary radiative element is substantially square in shaped.

16. The antenna of claim 11, wherein the primary radiative element is substantially rectangular in shape with one dimension different from another dimension.

17. The antenna of claim 11, wherein the primary radiative element comprises a first primary radiative element and a second radiative element arranged along the first axis, wherein the first primary radiative element has a longitudinal axis substantially parallel to the first axis and located between the first parasitic element and the third parasitic element, and the second primary radiative element has a longitudinal axis substantially perpendicular to the first axis and located between the second parasitic element and the fourth parasitic element, and wherein the first slot and the first primary radiative element are arranged along an axis substantially perpendicular to the first axis, and the second slot and the second primary radiative element are arranged along another axis substantially perpendicular to the first axis.

18. The antenna of claim 11, wherein the first parasitic element is spaced from the primary radiative element by a first distance and the third parasitic element is spaced from the primary radiative element by a second distance substantially equal to the first distance, and the third parasitic element is spaced from the primary radiative element by a third distance and the fourth parasitic element is spaced from the primary radiative element by a fourth distance substantially equal to the third distance.

19. The antenna of claim 11, wherein the first parasitic element is spaced from the primary radiative element by a first distance and the third parasitic element is spaced from the primary radiative element by a second distance different from the first distance, and the third parasitic element is spaced from the primary radiative element by a third distance and the fourth parasitic element is spaced from the primary radiative element by a fourth distance different from the third distance.

20. An antenna array, comprising a plurality of antennas as claimed in claim 11, wherein said plurality of antennas are arranged spaced from each other along the first axis.

21. An electronic device, comprising an antenna as claims in claim 11.

22. The electronic device of claim 21, comprising a mobile terminal.

23. The electronic device of claim 21, comprising an access point.

* * * * *